United States Patent [19]

Debry

[11] Patent Number: 4,524,713

[45] Date of Patent: Jun. 25, 1985

[54] WAX TOOL

[76] Inventor: Paul Debry, P.O. Box 1365, New Smyrna Beach, Fla. 32070-1365

[21] Appl. No.: 601,723

[22] Filed: Apr. 18, 1984

[51] Int. Cl.[3] ..... B05C 11/02

[52] U.S. Cl. ..... 118/102; 15/142

[58] Field of Search ..... 118/102; 30/164.9; 15/142

[56] References Cited

U.S. PATENT DOCUMENTS 1,579,961 4/1926 Shope ..... 15/142 X 2,127,130 8/1938 Meuwsen ..... 30/164.9

3,994,040 11/1976 DiStefano ..... 30/164.9 X

FOREIGN PATENT DOCUMENTS 1023706 1/1958 Fed. Rep. of Germany ..... 118/102

*Primary Examiner*—John P. McIntosh

[57] ABSTRACT

This tool is used to produce specific patterns in wax on sporting equipment, such as surfboards, sailboards, skis, etc. Primarily, it consists of a hand-held body, having a multiple number of spaced pins or teeth secured to its bottom, which are used to produce the patterns which will provide greater traction for the equipment.

1 Claim, 8 Drawing Figures

FIG. 1
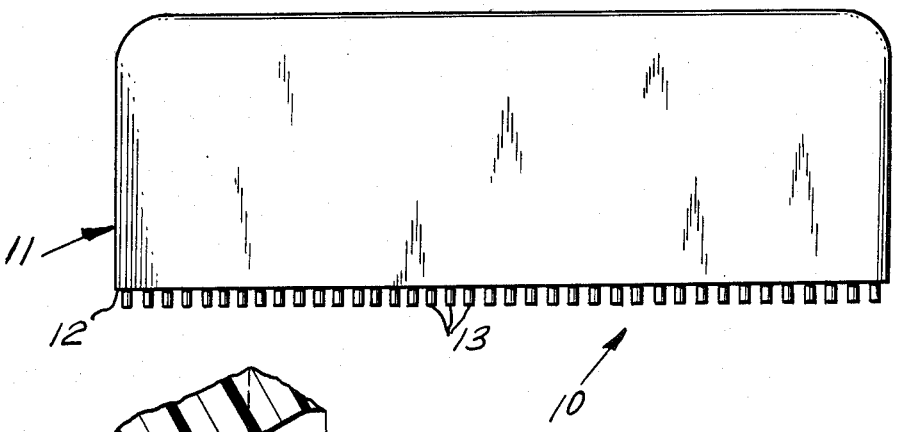
FIG. 2
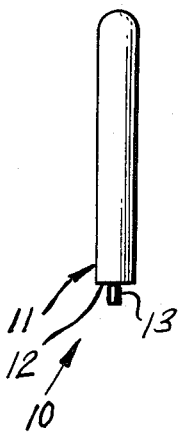
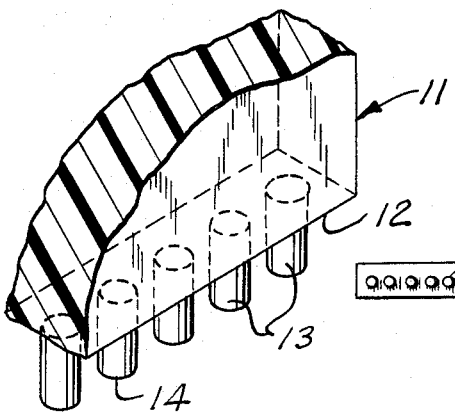
FIG. 3
FIG. 4
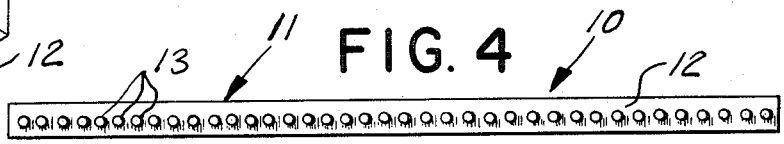
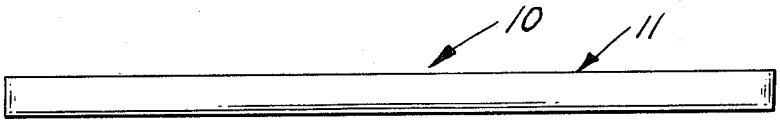
FIG. 5
FIG. 6
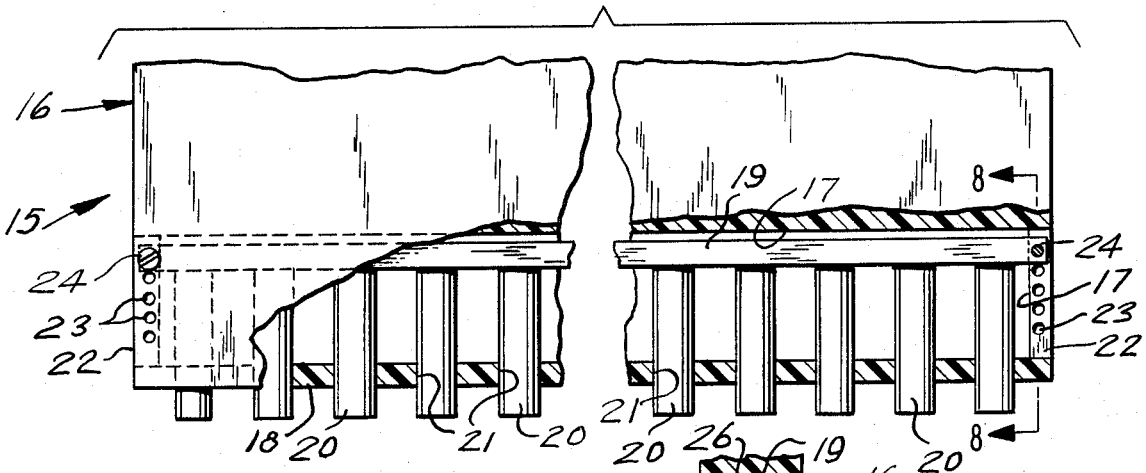
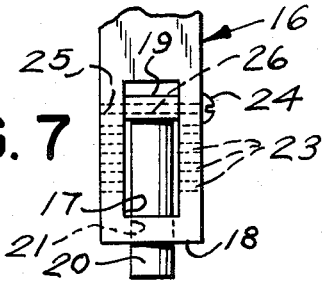
FIG. 7
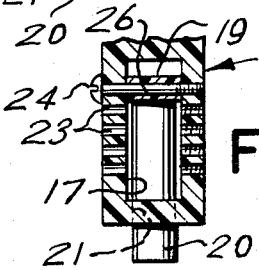
FIG. 8

WAX TOOL

This invention relates to pattern making devices, and more particularly to a wax tool.

The principal object of this invention is to provide a wax tool, which will be employed to produce a specific pattern.

Another object of this invention is to provide a wax tool, which will be of such design, as to scribe a specific pattern on sporting equipment, such as surfboards, skis, sailboards, etc.

A further object of this invention is to provide a wax tool, which will be employed to produce patterns with wax on sporting equipment, to thus provide maximum traction when the equipment is being used.

Other objects are to provide a wax tool, which is simple in design, inexpensive to manufacture, rugged in construction, easy to use, and efficient in operation.

These, and other objects, will be readily evident, upon a study of the following specification, and the accompanying drawing, wherein:

FIG. 1 is a front elevational view of the present invention;

FIG. 2 is an end view of FIG. 1;

FIG. 3 is an enlarged fragmentary perspective view of FIG. 1;

FIG. 4 is a bottom plan view of FIG. 1;

FIG. 5 is a top plan view of FIG. 1;

FIG. 6 is an enlarged side elevational view of a modified form of the invention, shown partly broken away;

FIG. 7 is a fragmentary left side view of FIG. 6, and

FIG. 8 is a cross-sectional view, taken along the line 8—8 of FIG. 6.

Accordingly, a tool 10 is shown to include a flat plastic body 11, which is rounded on its top portion and flat on its bottom surface 12. A plurality of equally spaced teeth 13, of suitable hard material, are fixedly secured at one end to bottom surface 12, in a suitable manner, and are two millimeters in height. Teeth 13 are also one millimeter in diameter, and are spaced one millimeter apart. They are cylindrical in shape preferably, and the circular peripheral edges are square, rather than including a radius thereon.

In use, tool 10 is held in the hand of the user, and while the wax on the surface of the equipment is warm, the user urges the teeth into the wax, and forms the specific pattern desired in the wax, which will provide for maximum traction for the user, when using the sporting equipment.

Looking now at FIGS. 6 through 8, a modified tool 15 is shown to include an elongated plastic body 16, having an opening 17 extending through its bottom, above the bottom wall 18 thereof. A plastic bar 19 is elevatable within opening 17, for the adjustment of the projection of pins or teeth 20, which are freely and slideably received within openings 21 through the bottom wall 18. The upper ends of teeth 20 are fixedly secured to the bottom surface of bar 19 in a suitable manner, and the end walls 22 are provided with a plurality of spaced openings 23, which may selectively receive screw fasteners 24, which are threadingly received in openings 25 of body 16, and are freely received within openings 26 through the ends of bar 19. By removing screw fasteners 24 from body 11 and its bar 19, bar 19 may be lowered or elevated to adjust teeth 20 to any desired projection depth in wax, and it is held in its desired elevation by replacing fasteners 24 in the proper openings 23 and the threaded openings 25.

In use, tool 15 functions in the same manner heretofore described of tool 10, with the exception, that the teeth 20 may be lowered or elevated to any desired depth, by removing fasteners 24 and placing bar 19 at any level desired within body 16. When the desired level is attained, the bar 19 is again secured by means of the fasteners 24.

While various changes may be made in the detail construction, it is understood that such changes will be within the spirit and scope of the present invention, as is defined by the appended claims.

What I now claim is:

1. A wax tool for scribing a pattern in a warmed wax, comprising, in combination, a flat body, a row of equally spaced-apart teeth projecting from one longitudinal edge of said main body, each said tooth being transversely round and having a flat end face at right angle to a longitudinal axis of said tooth, a longitudinal opening through said main body, a bar slidable in said opening, said teeth being affixed along said bar and extending through a plurality of holes of a wall of said main body having said longitudinal edge, and a pair of screw fasteners received through transverse openings in said bar and selected ones of a plurality of transverse openings in said main body for selective projecting distance of said teeth from said main body.

* * * * *